US006364092B1

(12) United States Patent
Felix

(10) Patent No.: US 6,364,092 B1
(45) Date of Patent: Apr. 2, 2002

(54) DEVICE FOR DEVIATING RAIL-GUIDED TRANSPORT ITEMS FROM ONE RAIL TRACK TO ANOTHER

(75) Inventor: Markus Felix, Uster (CH)

(73) Assignee: IPT Weinfeldin AG, Weinfeld (CH)

( * ) Notice: Subject to any disclaimer, the term of this patent is extended or adjusted under 35 U.S.C. 154(b) by 0 days.

(21) Appl. No.: 09/346,091

(22) Filed: Jul. 1, 1999

(30) Foreign Application Priority Data

Jan. 15, 1997 (CH) ..... 0065/97

(51) Int. Cl.[7] ..... B65G 47/26
(52) U.S. Cl. ..... 198/439
(58) Field of Search ..... 198/439, 350, 198/370.13, 441

(56) References Cited

U.S. PATENT DOCUMENTS 2,363,189 A * 11/1944 Magnusson
2,770,349 A * 11/1956 Nordquist
2,835,375 A * 5/1958 McGihon
2,843,254 A * 7/1958 Vaughan
3,098,552 A * 7/1963 Schulz
3,967,717 A * 7/1976 Bauer
4,039,182 A 8/1977 Reist et al. ..... 271/64
5,007,624 A 4/1991 Chandhoke ..... 270/52
5,113,996 A * 5/1992 Francioni ..... 198/441

* cited by examiner

*Primary Examiner*—Kenneth W. Noland
(74) *Attorney, Agent, or Firm*—Brinks Hofer Gilson & Lione

(57) ABSTRACT

The deviating device (26, 26') for feeding transport items (12) occurring on the first rail track (14) to the second or third rail track (16, 18), which is arranged at an angle ($\alpha$, $\alpha'$) with respect to the first rail track (14), are arranged lying radially on the inside with respect to the bend of the transitional region between the first rail track (14) and the second or third rail track (16, 18). They have a conveying disk (28), driven continuously in rotation, and a coupling means (56), designed as a lamellar wheel (42). The lamellae (42') of the lamellar wheel (42) can be transferred in a controlled manner into a clamping position, in order to firmly clamp a transport item (12) between them and the conveying disk (28) and lead it through the deviating region.

32 Claims, 6 Drawing Sheets

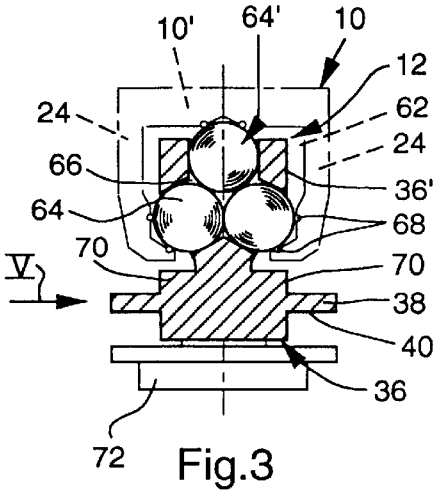
Fig.3
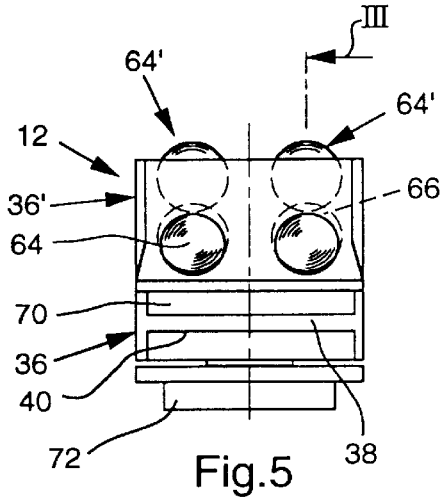
Fig.5
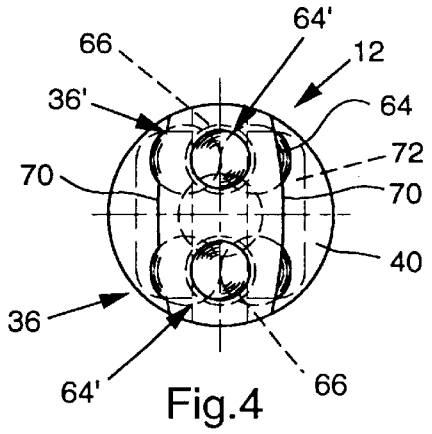
Fig.4
Fig.6
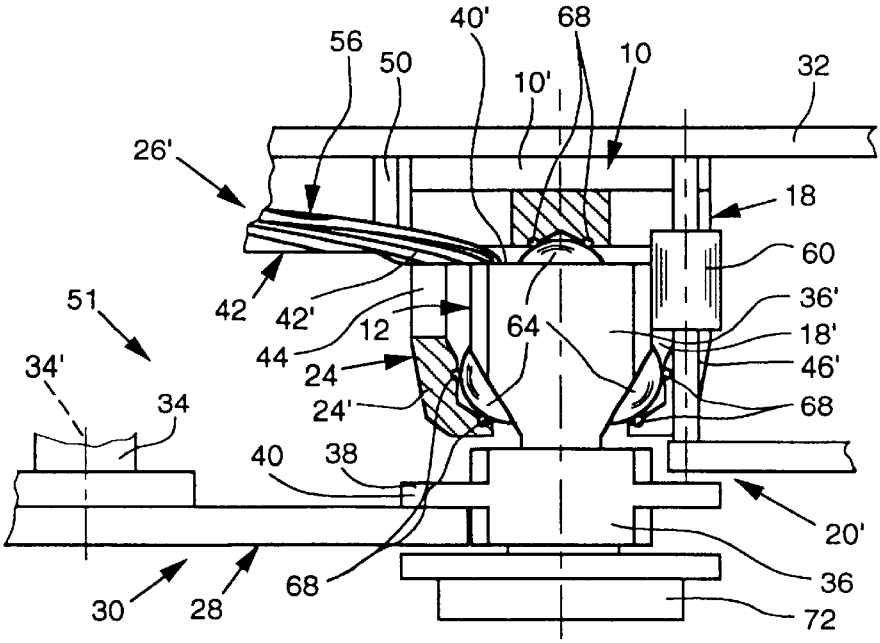

Fig.7
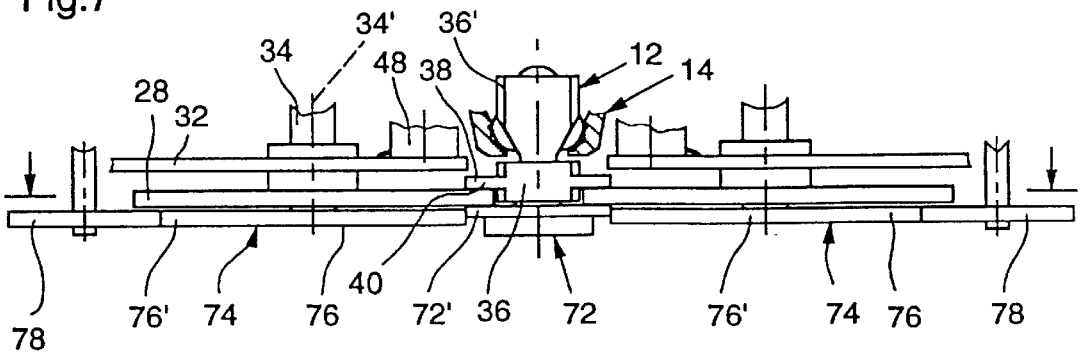
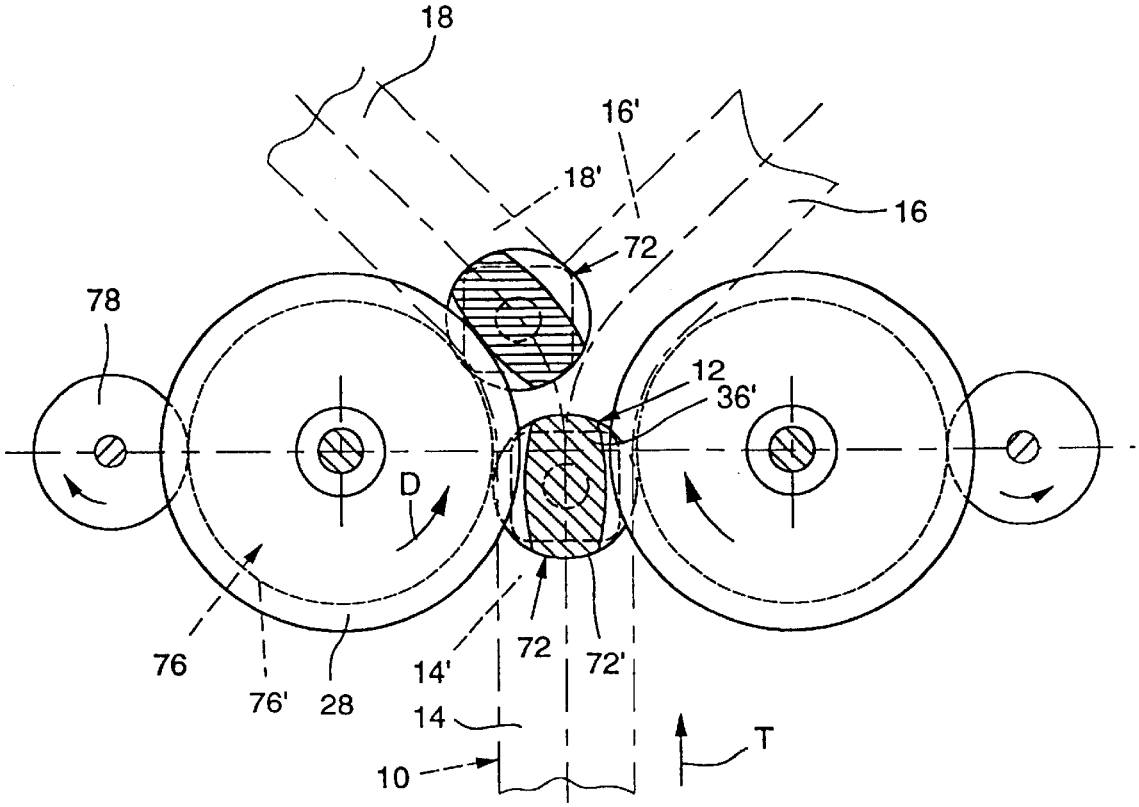
Fig.8

DEVICE FOR DEVIATING RAIL-GUIDED TRANSPORT ITEMS FROM ONE RAIL TRACK TO ANOTHER

BACKGROUND OF THE INVENTION

The present invention relates to a device for deviating rail-guided transport bodies independent of one another from the guide region of a first rail track to the guide region of a second rail track arranged at an angle relative to the first rail track.

The older Switzerland Patent Application No. 1996 1818/96 discloses a device for feeding printing house products to processing stations. It has a rail system on which carriages independent of one another and equipped with clamps are guided for the purpose of transporting the printing house products. A main conveying section of the rail system is connected via controlled switches to supply sections leading to the processing stations. The supply sections are followed by return sections which open again, via switches, into the main conveying section in order to return the clamps into the latter. In devices of this type with carriages independent of one another which are freely movable along large parts of the rail system, the distance between successive carriages may vary greatly. It is, therefore, possible for successive carriages to come to bear against one another. This may lead to problems, particularly at junctions of the rail system and when two tracks of the rail system converge into one track. In particular, changeover of switch tongues after a carriage has passed through can be ensured only if care is taken to make sure that the next carriage does not follow until after a specific time or distance.

Similar problems arise when two tracks of the rail system converge if the carriages arriving on the two tracks do not occur there with a specific difference in time between them. Devices of this type require considerable outlay in terms of sensor, control, entry/exit and timing arrangements in order to ensure smooth operation.

BRIEF SUMMARY OF THE INVENTION

One object of the present invention is to provide a device for deviating rail-guided transport items independent of one another from the guide region of a first rail track to the guide region of a second rail track arranged at an angle relative to the first rail track, said device ensuring, along with a high processing capacity, the deviation of transport items occurring on the first rail track even when these follow one another at a very short distance or even come to bear against one another.

This object is achieved by means of a device which has the features of claim 1. The solution according to the invention makes it possible to dispense with a radially outer guide for the carrying bodies in the transitional region from the guide region of the first rail track to the guide region of the second rail track. A switch tongue may, therefore, be dispensed with at carriage deviation points in switches, thus eliminating all the problems presented by the changeover of switch tongues. Furthermore, the transport items are actively conveyed in the transitional region and they, therefore, have an exactly defined speed at the deviation point and run into the second rail track at this speed. This affords advantageous preconditions for the downline further processing of the transport items.

The coupling means for coupling the transport items to the conveying element of the deviation apparatus may be arranged on the transport items themselves. Advantageously, however, as specified in claim 3, the coupling means are assigned to the deviation apparatus. This allows the transport items to have an extremely simple embodiment.

A particularly preferred embodiment of the device according to the invention is defined in claim 4. If the deviation apparatus and the coupling means form a clamping arrangement for the transport items, the rail-side guidance of the transport items can be partially or even completely canceled in the transitional region.

A particularly preferred embodiment of the device according to the invention is defined in claim 5. It allows the transport items and coupling means to have an extremely simple design.

An embodiment of the device according to the invention, said embodiment being particularly simple in terms of construction and for the purpose of actuation, is specified in claim 6.

Another particularly preferred embodiment of the device according to the invention is defined in claim 7. A circular-segmental path of movement of the transport items in the transitional region makes it possible for the support element to be designed in the form of a circular disk or a wheel.

Another preferred embodiment of the device according to the invention, as claimed in claim 8, makes it possible to design the device with a rectilinear portion. If driving members are provided, the transport items assume a defined position relative to one another in the region of the device, thus affording advantages particularly when two tracks converge into one track.

By means of another preferred embodiment of the device according to the invention, as claimed in claim 9, transport items independent of one another can be processed at the desired time. As a result, particularly when two tracks converge, collisions of transport items occurring on both tracks can be prevented.

A particularly preferred embodiment of the device according to the invention for supplying transport items occurring on one track to two tracks is defined in claim 10.

A particularly preferred embodiment of the device according to the invention for transferring transport items occurring on two tracks into a single track is specified in claim 11.

In a device designed according to claim 12, a collision of transport items is prevented in an extremely simple way.

An embodiment of the device according to the invention, said embodiment being capable of being produced particularly economically, is defined in claim 13. It requires only a small number of different parts.

A particularly preferred embodiment of the device according to the invention is specified in claim 14. Inside runners can be designed to be particularly small. A guide element ensures that the transport items run optimally into the guide region of the downline rail track.

The particularly preferred embodiment of the device according to the invention, as claimed in claim 15, makes it possible to process sheet-like products, in particular printing house products, individually. Products occurring at various sources can be converged for their further processing and products occurring on one track can be divided up for further processing.

Another particularly preferred embodiment of the device according to the invention, as claimed in claim 16, makes it possible to prepare the products according to the requirements of the following processing stations.

The particularly preferred embodiment of the transport items, as claimed in claim 17, makes it possible to have a simple design of timed-entry units and optimum cooperation between these and the transport items.

The invention is described in more detail with reference to exemplary embodiments illustrated in the purely diagrammatic drawing in which:

BRIEF DESCRIPTION OF THE DRAWINGS

FIG. 3 shows a transport item guided in a rail, in section along the line III—III of FIG. 5;

FIG. 4 shows a top view of the transport item according to FIG. 3;

FIG. 5 shows the transport item shown in FIGS. 3 and 4 in a side view in the direction of the arrow V of FIG. 3;

FIG. 6 shows part of the device shown in FIGS. 1 and 2, in section along the line VI of FIG. 1;

FIG. 7 shows an illustration, corresponding to FIG. 2, of part of the embodiment of the device shown in FIGS. 1 and 2, with an accessory for the rotation of carrying elements arranged on the transport items;

FIG. 8 shows a top view of part of the device shown in FIG. 7;

DETAILED DESCRIPTION OF THE INVENTION

Figure 2:
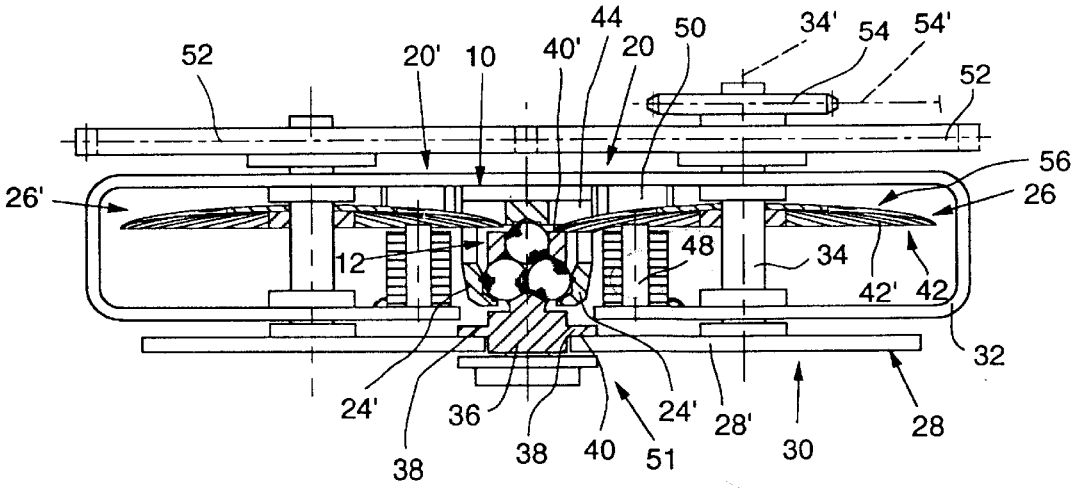
FIG. 2 shows the device shown in FIG. 1, in a section along the line II—II of FIG. 1.
Figure 1:
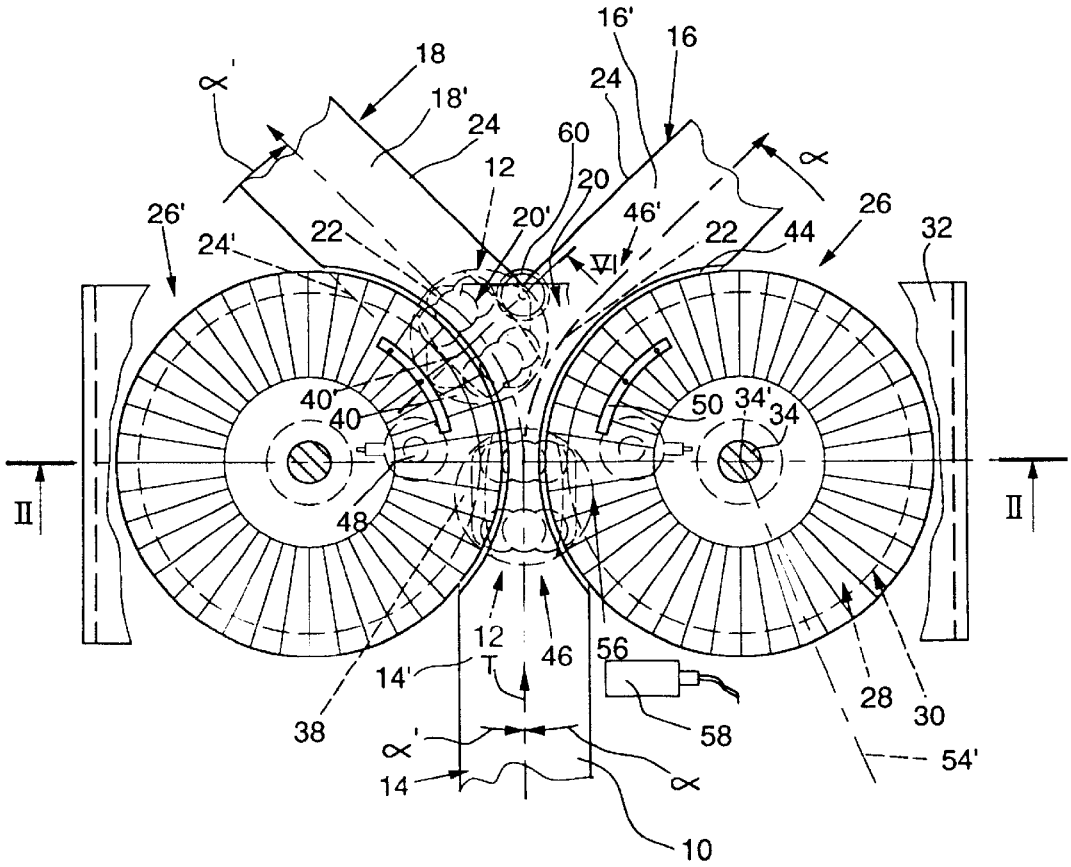
FIG. 1 shows a top view of a device according to the invention with rail tracks arranged in a bifurcated manner.

The device shown in FIGS. 1 and 2 has a rail system with rails 10 of C-shaped cross section, in which transport items 12 independent of one another and designed as inside runners are guided so as to be freely movable. A first rail track 14 is followed, as seen in the direction of transport T of the transport items 12, by a second rail track 16 and a third rail track 18. The second and third rail tracks 16, 18 arranged symmetrically with respect to the first rail track 14 and in each case form an angle $\alpha$ and $\alpha'$ of 135° C. with the latter. However, this angle may also be larger or smaller. A first transitional region 20 with a circular-arcuate bend 22 extends from the guide region 14' of the first rail track 14 to the guide region 16' of the second rail track 16. The guide regions 14', 16' of the two respective rail tracks 14, 16 follow the bend 22 in the tangential direction. A corresponding second transitional region 20' with an opposite bend 22 extends from the first rail track 14 to the third rail track 18. The lateral flank 24 of the rail assigned to the second rail track, said lateral flank being on the outside with respect to the bend 22 of the first transitional region 20, terminates at the third rail track 18. The outer lateral flank 24 of the rail 10 of the third rail track 18 likewise terminates at the second rail track 16. In the two transitional regions 20, 20', therefore, the second and third rail tracks 16, 18 do not perform any guiding function on the transport items 12 radially on the outside.

The lateral flanks 24 of the second and third rail tracks 16, 18, said lateral flanks being radially on the inside in relation to the respective bend 22, are continued in the transitional region 20, 20', so as to form a guide element 24', and merge into the lateral flanks of the rail 10 of the first rail track 14.

Arranged on the inner side of the first transitional region 20, with respect to the bend 22 of the latter, is a first deviation apparatus 26 with a conveying element 30 driven in rotation in the direction of transport T designed as a conveying disk 28. A second deviation apparatus 26', which is assigned to the second transitional region 20', is arranged mirror-symmetrically to the first deviation apparatus 26 with respect to a mid-plane of the first rail track 14. The two deviation apparatuses 26, 26' are designed mirror-symmetrically.

The conveying disk 28 is fastened to the lower end of a shaft 34 mounted on a frame 32. The axis 34' of the shaft 34 coincides with the mid-point on the circular bend 22 of the respective transitional region 20. As may be gathered from FIG. 2, the transport items 12 project with a transport item part 36 above the rail 10 and, as seen in the direction of transport T, have tongue-like projections 38 on both sides on the transport item part 36. The lower faces of these projections 38, which face away from the rail 10, form a shoulder 40 which is intended to come to bear on the upper face of the conveying disk 28; the latter thus forms a support element 28' for the transport items 12.

A lamellar wheel 42 is fastened to the shaft 34 above the conveying disk 28. The size of the lamellar wheel 42 is selected in such a way that it engages into a recess 44 of the rail system in the transitional region 20 and into ending and starting portions 46, 46' of the first and second rail tracks 14, 16 respectively, said portions following the transitional region 20, in order to cooperate with upper shoulders 40' of the transport items 12. The lamellae 42' of the lamellar wheel 42 are formed by radially extending cuts in a disk consisting of resiliently elastic ferromagnetic material, said disk being bent in an umbrella-like manner and forming the lamellar wheel 42.

As seen in the direction of transport T, an electromagnet 48 is fastened to the frame 32 at the start of each transitional region 20, 20' said electromagnet being intended, in the excited state, to put the lamellae 42', moved past it, from a position of rest, in the direction toward the conveying disk 28, into a clamping position. The electromagnet 48 is directly followed downline by a clamping slot assembly 50 which is likewise fastened to the frame 32 and which is intended to continue to hold the lamellae 42' put into the clamping position by means of the electromagnet 48, in the clamping position, until said lamellae have reached the start of the guide region 16', 18' of the second or third rail track 16, 18. The clamping slot assembly 50 also puts the remaining lamellae 42' into the clamping position, but these cannot act on transport item 12 located in each case in the other transitional region 20 or 20', since said transport item is outside the effective range of the lamellae 42' influenced by the clamping slot assemblies 50. The lamellar wheel 42 together with the associated electromagnet 48 thus forms a controlled clamping element 51 for the transport items 12 to be deviated, said clamping element cooperating with the support element 28'.

A gearwheel 52 is seated on the shaft 34 of each deviation apparatus 26, 26'. These gearwheels 52 of equal size mesh with one another, in order to drive the two deviation apparatuses 26, 26' synchronously and in opposite directions of rotation. Also seated on the shaft 34 of the first deviation apparatus 26 is a chain wheel 54 of a chain drive 54' connected to a drive motor and intended for driving the deviation apparatus 26, 26'.

The lamellar wheel 42 and the controlled electromagnet 48 thus form a coupling means 56, in order to couple transport items 12, to be supplied to the respective rail track 16 or 18, to the conveying element 30 of the deviation apparatus 26 or 26' assigned to the respective rail track 16, 18.

As seen in the direction of transport T, the deviation apparatuses 26, 26' are preceded by a sensor 58. This is intended for detecting an oncoming transport item 12 and, if appropriate, reading a coding affixed to it. The output signals from the sensor 58 are supplied to a control apparatus, not shown, which activates the electromagnets 48 in order to supply the transport item 12 to the desired second or third rail track 16, 18.

At the point where the radially outer lateral flanks 24 of the second and third rail tracks 16, 18 butt one against the other, a steering roller 60 is mounted freely rotatably, in order to guide, radially on the outside, transport items 12 deviated in one of the two directions, when they run into the respective rail track 16, 18.

The transport item 12 shown in FIGS. 3 to 5 has a transport item part 36' which is arranged in a running channel 62 formed by the rail 10 and in which the balls 64 of two ball triplets 64' arranged one behind the other, as seen in the direction of transport T, are mounted freely rotatably. For receiving the three balls 64 of a triplet 64' in each case, the transport item part 36' has a Y-like cage 66, the balls 64 arranged in the arms of this cage being capable of touching one another and of rolling on one another. Each ball 64 of a triplet 64' is guided, at its part projecting beyond the transport item 12, on a pair of ball runways 68 arranged on the rail 10. One pair of ball runways 68 is arranged in each case at the end region of each lateral flank 24 of the rail 10 and the third is arranged on the rail web 10' connecting the two lateral flanks 24. The design of the rail 10 and of the transport item part 36' arranged in the running channel 62 and having the ball triplet 64', and their cooperation with the rail 10, are described in detail in EP-A-0, 387, 318.

The transport item part 36 projecting from the running channel 62 and designed in one piece with the transport item part 36' has, laterally, the projections 38 described further above, with the shoulders 40. Lateral convex driving faces 70, the purpose and functioning of which are described further below, are integrally formed on that side of the projections 38 which faces the rail 10 and the transport item part 36'.

Fastened to the transport item part 36 on the end face of the latter which faces away from the transport item part 36' is a carrying element 72, on which, for example, a clamp for the transport of printing house products can be mounted.

FIG. 6 shows, in part, the second deviation apparatus 26', shown in FIGS. 1 and 2, during the deviation of a transport item 12 in the second transitional region 20', the transport item 12 being introduced into the guide region 18' of the third rail track 18. The transport item 12 rests with its shoulder 40 on the conveying disk 28, and lamellae 42' of the lamellar wheel 42, which are held in the clamping position by means of the clamping slot assembly 50, bear on the shoulder 40'. In the transitional region 20', the balls 64 facing the web 10' of the rail 10 and those facing the radially inner lateral flank 24 forming the guide element 24' are guided on corresponding pairs of ball runways 68, whereas the radially outer balls 64 are fine and are guided again only after they have run into the guide region 18' of the third rail track 18. The steering roller 60 acting on the transport item part 36' assists the run of the balls 64 onto the pair of ball runways 68 assigned to said balls. As may also be gathered from FIG. 6, the lamellae 42' release the transport item 12 and run off the clamping slot assembly 50, as soon as the transport item 12 is guided in the guide region 18'.

In the embodiment shown in FIGS. 7 and 8, the carrying elements 72 are mounted on the transport items 12 rotatably about the axis 34', and the deviation apparatuses 26, 26' shown in FIGS. 1 and 2 and described further above have control means 74 for the rotation of the carrying element 72. On that side of the conveying disk 28 which faces away from the lamellar wheel 42, there is mounted freely rotatably on the end face of the shaft 34 a control wheel 76 which is driven in rotation in the direction of the arrow D, and therefore in the direction of transport T, via a driving wheel 78 acting on the outer surface 76' of said control wheel and connected to a drive. The control wheel 76 is intended for cooperating by means of its outer surface 76' with a circular-cylindrical outer surface 72' of the carrying element 72. When the rotational speed of the control wheel 76 corresponds to the rotational speed of the conveying disk 28 and of the lamellar wheel 42, the carrying element 72 maintains its rotary position in relation to the transport item 12 in the transitional region 20 or 20'.

If the rotational speed of the control wheel 76 is higher than the rotational speed of the conveying disk 28 and of the lamellar wheel 42, the carrying element 72 is rotated in the opposite direction to the bend 22 in relation to the transport item 12. A rotational speed of the control wheel 76 which is lower than the rotational speed of the conveying disk 28 and of the lamellar wheel 42 results in the rotation of the carrying element 72 in the direction of the bend 22. In the example shown, the rotational speeds are coordinated with one another in such a way that the carrying element 72 maintains, in the bend 22, the orientation which it had in the first rail track 14 when it ran into the transitional region 20'.

Figure 9:
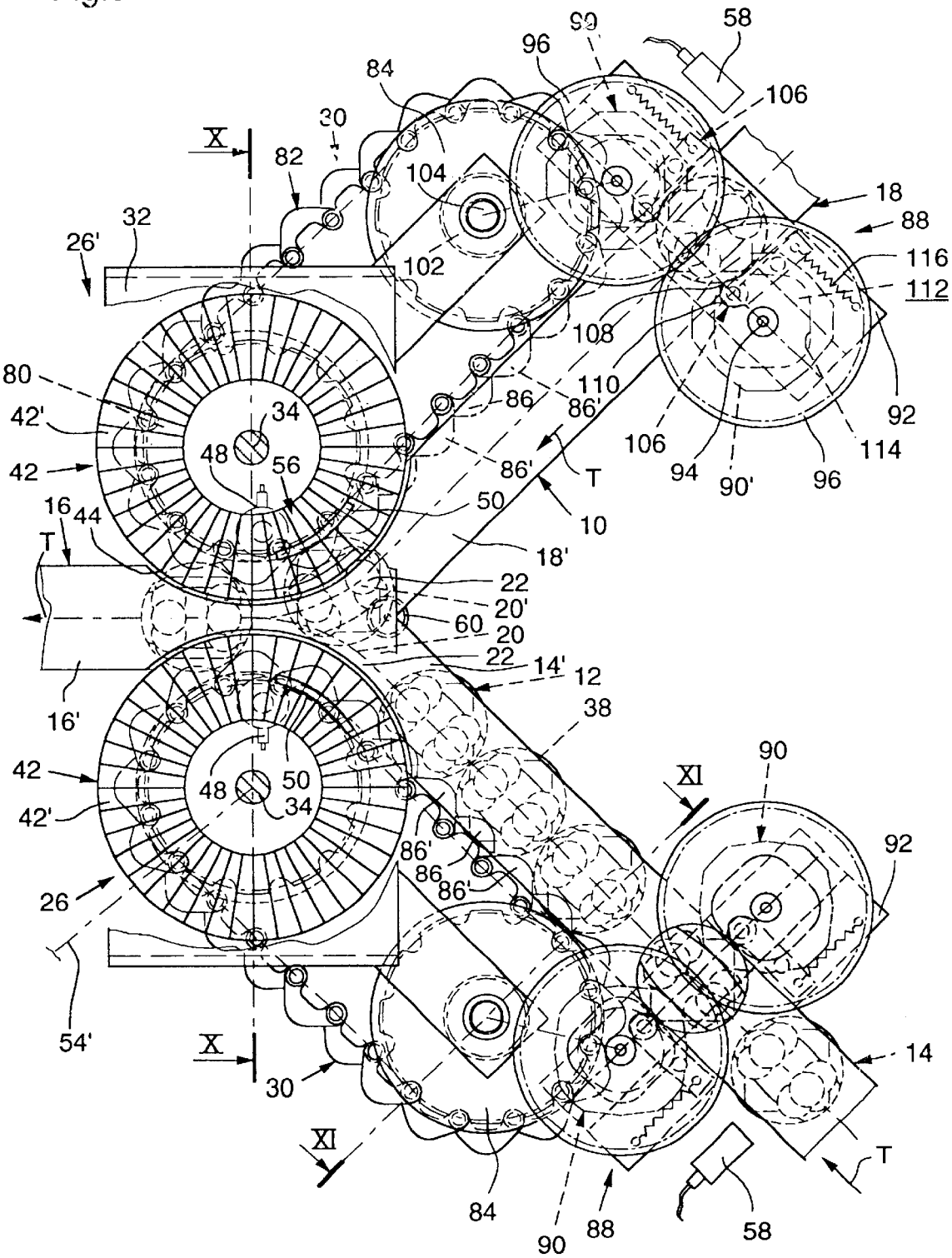
FIG. 9 shows a top view of an embodiment of the device according to the invention, at the convergence of two tracks into one track.
Figure 11:
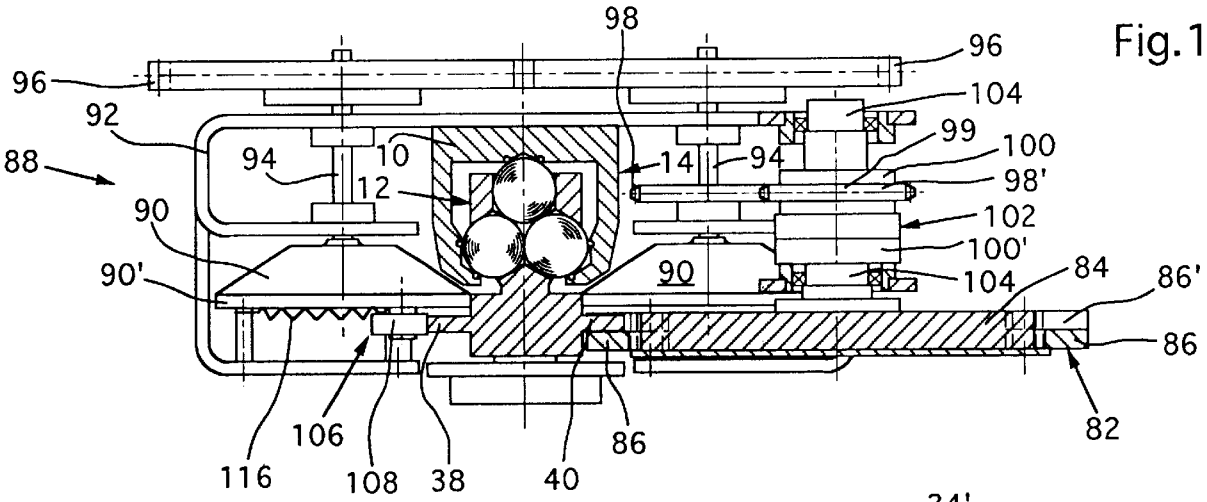
FIG. 11 shows the device shown in FIG. 9, with a timed-entry unit, in section along the line XI—XI.
Figure 10:
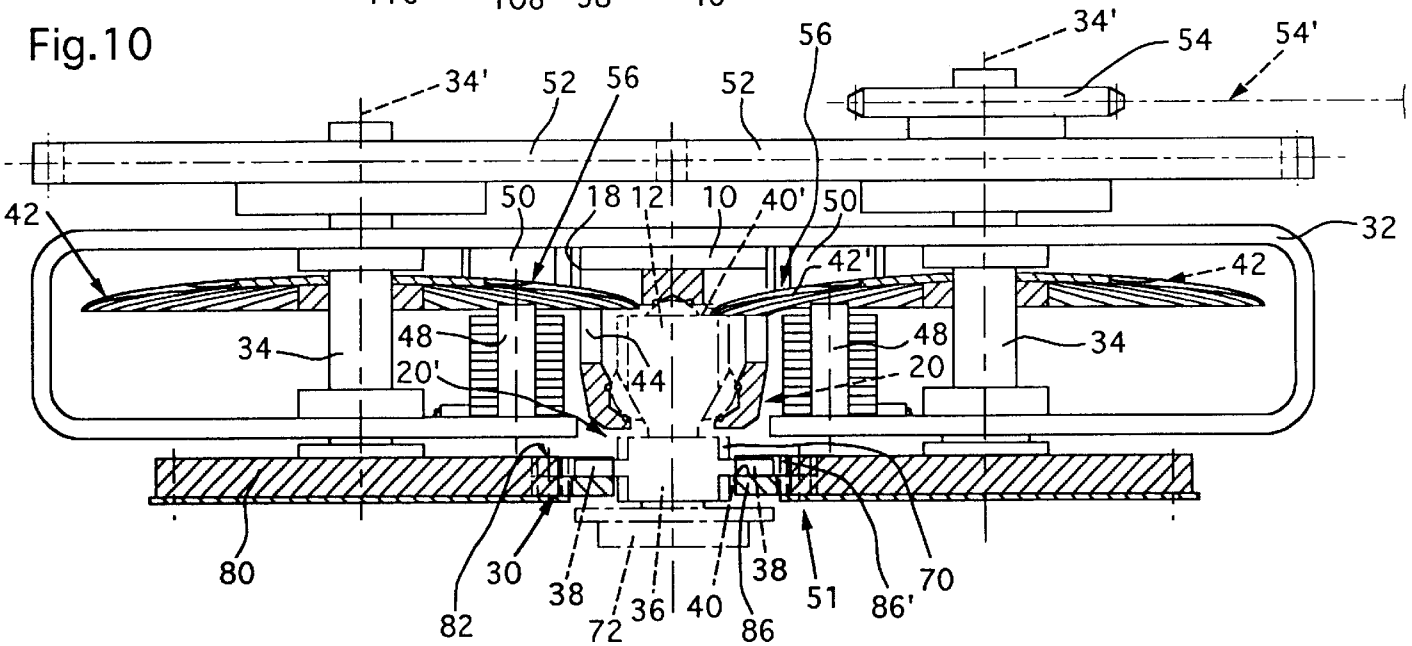
FIG. 10 shows the device shown in FIG. 9, in section along the line X—X of FIG. 9.

The deviation apparatuses 26, 26' shown in FIGS. 9 and 10, have essentially the same design as the deviation apparatuses shown in FIGS. 1 and 2. Those parts of the deviation apparatuses 26, 26' shown in FIGS. 9 and 10 which are of identical design and perform the same function as in the exemplary embodiment shown in FIGS. 1 and 2 are given the same reference symbols; reference is made to the corresponding passages of the description further above.

Instead of the conveying disk 28, a chain wheel 80 is seated fixedly in terms of rotation on the shaft 34, there being guided around said chain wheel a conveying chain 82 which forms a conveying element 30 which, on the other hand, is guided around a deflecting wheel 84 which is arranged upline of the respective chain wheel 80 in relation to the direction of transport T of the first and third rail tracks 14, 18 and which is mounted freely rotatably on the frame 32.

Successive links of the conveying chain 82 are arranged alternately at the bottom and top, the lower links in each case forming a support member 86 which is intended for cooperating as support element 28' with the shoulders 40 of the transport items 12. The links adjacent to a support member 86 form driving links 86' which between them receive the projections 38 of the transport items 12 fixedly in driving terms.

In the present case, transport items 12 occurring on the first rail track 14 and third rail track 18 in the direction of transport T are supplied to the second rail track 16 by means of the deviation apparatuses 26, 26'. In order to prevent the situation where, in the case of synchronously driven conveying chains 82, mutually corresponding support links 86 of the two conveying chains 82 are occupied by transport items 12, the two deflecting wheels 84 are preceded, as seen in the direction of transport T, in each case by a timed-entry unit 88. Since the timed-entry units 88 are driven in exact opposition, a collision of two transport items 12 in the transitional regions 20, 20' can be avoided in a simple way. The first and third rail tracks 14, 18 are each assigned a sensor 58 which precedes the respective timed-entry unit 88 and which detects oncoming transport items 12 and transmits corresponding signals to a control unit, not shown, for activating the timed-entry units 88 and the magnets 48 putting the lamellae 42' of the lamellar wheels 42 into the clamping position.

The clamping slot assemblies 50 directly precede the electromagnets 48. The latter put each lamellae 42' moved past them into the clamping position. When the electromagnet 48 is deexcited, however, the lamellae 42' move back into the position of rest again, before they can act on a transport item 12 which is deviated by means of the other deviation apparatus 26 or 26'.

The design and functioning of the timed-entry units 88 may be gathered from FIGS. 11 to 14. Each of the time-entry units 88 has, on both sides of the rail 10 forming the respective rail track 14 or 18, a frustoconical driving wheel 90 with a polygonal circumference. The driving wheels 90 are seated on shafts 94 which are mounted on a further frame 92 and which are themselves drive-connected to one another via intermeshing gear wheels 96 of the same diameter. Also seated, fixedly in terms of rotation, on one of these shafts 94 is a chain wheel 98, around which is guided a chain 99 which, on the other hand, runs round a further chain wheel 98' seated on a coupling element 100. The coupling element 100 is part of a coupling 102 arranged on a shaft 104, to which the respective deflecting wheel 84 is fastened. The coupling 102 receives commands from the control apparatus, in order, on the one hand, to couple the shaft 94 for driving the timed-entry unit 88 to the shaft 104 and, on the other hand, to release this coupling and to stop the timed-entry unit 88, and keep it stopped, by coupling the coupling element 100 to a rotationally fixed element 100'.

A two-armed hold-back lever 106 is also rotatably mounted on the further frame 92 on each of the two sides of the rails 10. The two hold-back levers 106, arranged approximately parallel to the rail 10, have, at their lever end which is downline, as seen in the direction of transport T, a hold-back nose 108 and a freely rotatably mounted control roller 110 which engage from below into a recess 112 of the driving wheels 90; the outer surface of the recess 112 forms a control slot assembly 114 for the control rollers 110. At the end facing away from the control roller 110 and the hold-back nose 108, the hold-back levers 106 are fastened in each case to a spring 116 which, at the other end, is fastened to the further frame 92, in order to prestress the hold-back levers 106 in the hold-back position.

Figure 15:
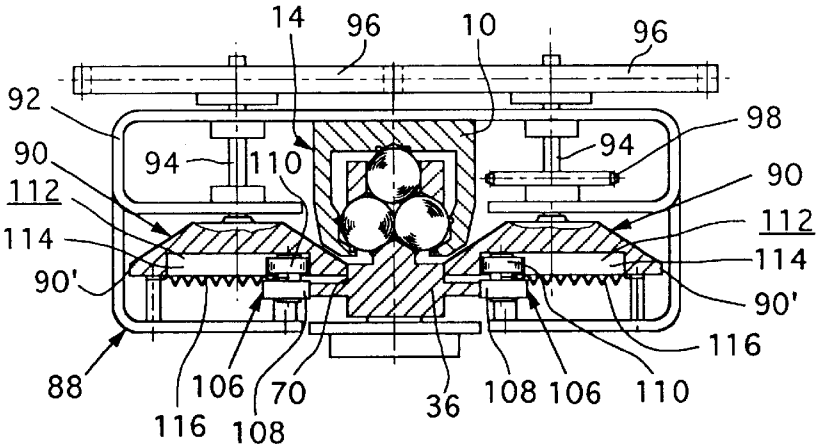
FIG. 15 shows the timed-entry unit in the clearing and driving position, in section along the line XV—XV of FIG. 14.
Figure 14:
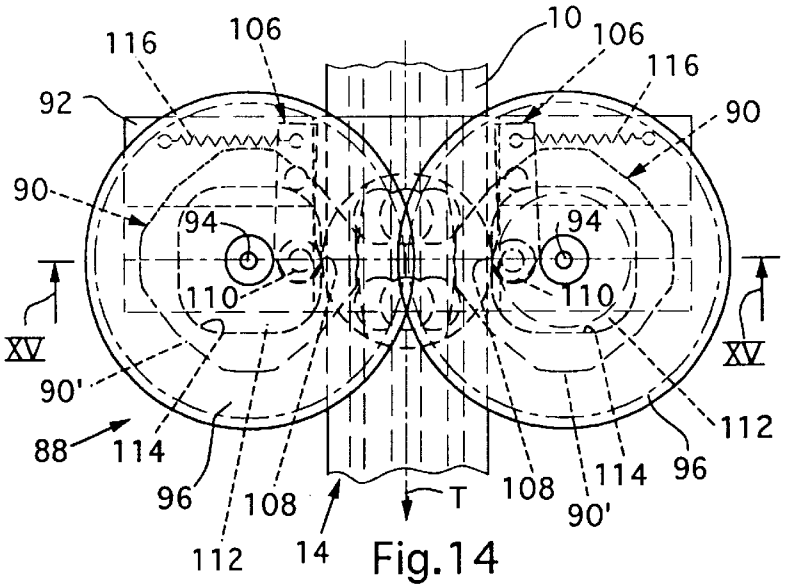
FIG. 14 shows a top view of the timed-entry unit shown in FIG. 12, in the clearing and driving positions.
Figure 13:
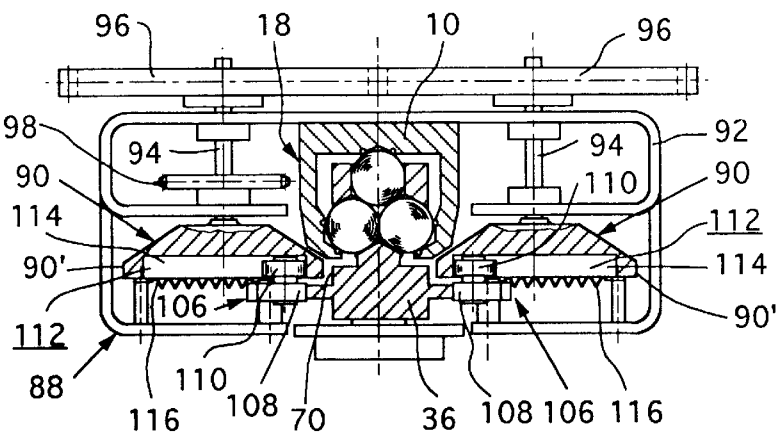
FIG. 13 shows the timed-entry unit in the hold-back position, in section along the line XIII—XIII of FIG. 12.
Figure 12:
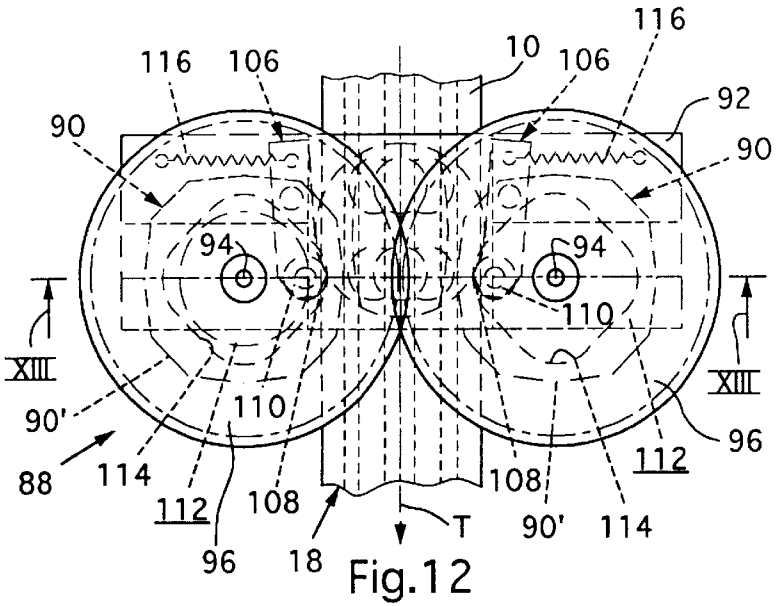
FIG. 12 shows a top view of the timed-entry unit shown in FIGS. 9 and 11, in the hold-back position for transport elements.

As may be gathered from FIGS. 12 and 14, the control slot assembly 114 has an essentially round four-cornered shape, in the hold-back position the control rollers 110 being arranged in each case in a rounded "corner region" of the control slot assembly 114, as shown in FIGS. 12 and 13. When the two driving wheels 90 are driven in opposite directions and in the direction of transport T, in each case by one quarter of a revolution, the control slot assemblies 114 first transfer the hold-back levers 106 into a release position, counter to the force of the springs 116, and, toward the end of this rotational movement, change them over into the hold-back position again. The release position of the hold-back levers 106 and the corresponding rotary position of the driving wheels 84 are shown in FIGS. 14 and 15.

The polygonal cylindrical outer surface 90' of the driving wheels 90 shaped in such a way that their distance from the axis of rotation of the shaft 94 is the shortest at the "corners" of the control slot assembly 114 and is the greatest in the mid-region of the control slot assemblies 114 between two "corners". When the hold-back levers 106 are in the hold-back position and the transport item 112 bears with its projection 38 against the hold-back noses 108, the driving wheels 90 also bear with their outer surface 90' against the driving faces 70 of the transport item part 36. The shape of the convex driving faces 70 and the shape of the likewise convex outer surface 90' of the driving wheels 90 are coordinated with one another in such a way that, when the driving wheels 90 rotate, their outer surfaces 90' roll the driving faces 70, specifically in such a way that the transport item 12 is accelerated in the direction of transport T. This purpose is served by the increase in distance of the outer surface 90' from the shaft 94.

The functioning of the device shown in FIGS. 1 and 2 is described first, and then that of the device shown in FIGS. 9 to 15.

A transport item 12 arriving in the first rail track 14 in the direction of transport T is detected by the sensor 58. If this transport item 12 is to be supplied to the third rail track 18, the electromagnet 48 assigned to the second deviation apparatus 26' arranged on the left, as seen in the direction of transport T, is excited. The lamellae 42' moved in each case past said electromagnet are thereby put into the clamping position, the result of this being that the transport item 12, coming to bear with its shoulder 40 located on the left, as seen in the direction of transport T, on the continuously driven conveying disk 28, is clamped between said conveying disk and the lamellar wheel 42. Since the electromagnets 48 of the deviation apparatus 26, 26' are activated in exact opposition, the transport item 12 held by the second deviation apparatus 26' can move, unimpeded, past the first deviation apparatus 26. The transport item 12 held by the second deviation apparatus 26' is conveyed through the second transitional region 20' and introduced into the guide region 18' of the third rail track 18. This is illustrated by means of a further transport item 12 located near the steering roller 60. As soon as the transport item 12 is in the guide region 18', the respective lamellae 42' release said transport item, since they no longer continue to be held in the clamping position by the clamping slot assembly and finally run off from the latter.

When an oncoming transport item 12 is to be supplied to the second rail track 16, the electromagnet 48 assigned to the deviation apparatus 26 located on the right, as seen in the direction of transport T, is excited, and the electromagnet 48 assigned to the second deviation apparatus 26' is simultaneously deexcited, the result of this being that the transport item 12 is clamped between the conveying disk 28 and the lamellar wheel 42 of the first deviation apparatus 26 and is led through the first transitional region 20 to the guide region 16' of the second rail track.

Since the transport items 12 are coupled to the respective deviation apparatus 26 or 26' in each case on the radially inner side, the transport items 12 can be processed in succession with any desired distance between them. This is true even when they come to bear against one another in the region of the first rail track 14.

By means of the embodiment of the device according to the invention, as shown in FIGS. 9 to 15, transport items 12 occurring on two rail tracks 14 and 18 are supplied to a single track, the second rail track 16. A transport item 12 arriving on the first or third rail track 14, 18 is detected by means of the respective sensor 58. On the basis of the signals from the sensors 58, the control apparatus decides which timed-entry unit 88 is released for the clearance and acceleration of the transport item 12. At the time illustrated in FIG. 9, the timed-entry unit 88 assigned to the third rail track is stopped, with the result that the respective transport item 12 bears against the hold-back levers 106, which are in the hold-back position, and cannot enter the effective range of the conveying chain 82 driven continuously in rotation.

The timed-entry unit 88 assigned to the first rail track 14 is temporarily drive-coupled to the deflecting wheel 84 and therefore to the respective, likewise continuously driven conveying chain 82 and first deviation apparatus 26. The hold-back levers 106 of said timed-entry unit have been pivoted into the release position as a result of the rotation of the driving wheels 90, and the transport item 12 located between the driving wheels 90 is accelerated in the direction of transport T. The release of the timed-entry unit 88 is synchronized with the movement of the conveying chain 82, so that the cleared and accelerated transport item 12 comes to bear between two driving links 86' on a support member 86. In the example shown, four successive support links 86 are then occupied in each case by a transport item 12, whereas the corresponding support links 86 of the conveying chain 82 assigned to the third rail track 18 are free. This, on the one hand, prevents two transport items 12 from running one onto the other at the convergence of the rail tracks 14, 18 and, on the other hand, controls the sequence of the supply of the transport items 12 to the second rail track 16.

The transport items 12 conveyed by means of the chain wheels 80 to the effective range of the lamellar wheels 42 are clamped there between the respective support link 86 and the lamellae 42' put into the clamping position by means of the clamping slot assemblies 58 and are conveyed through the transitional region 20 or 20' by means of the corresponding bend 22.

After the clamping assemblies 50 downline in the transitional region, the respective lamellae 42' are held in the clamping position by means of the excited corresponding electromagnet 48, until the respective transport item 12 is located in the guide region 16' of the second rail track 16. The electromagnet which in each case is not excited allows the lamellae 42', temporarily held in the clamping position by the associated clamping slot assembly 50, to move back into their position of rest, before they can influence a transport item 12 held by the other deviation apparatus in each case.

Since the transport items 12 are coupled to the conveying element 30 of the respective deviation apparatus in a transitional region, it is also possible for the transport items 12 to be transported completely through the transitional region without any rail-side guidance, thus also making it possible to deviate outside runners guided on rails.

The described principle of the deviation of transport items 12 from a first rail track 14 or 18 to a second rail track 16 or 18 can also be applied when two rail tracks, for example the rail tracks 14 and 16, are aligned with one another, that is to say when the angle a between these rail tracks is 180°. In this case, only one deviation apparatus 26 needs to be provided, which is arranged either on the inner side of the transitional region having a bend, as shown in the figures, or else, in the case of a rectilinear transitional region, on the outer side of the two aligned rail tracks. In the latter case, the conveying element 30 is designed, as shown in FIG. 9, the coupling means rotating along a closed path of rotation which has an elongate portion conforming to the profile of the conveying element 30.

What is claimed is:

1. A device, comprising a first rail track having a guide region and a second rail track arranged at an angle to the first rail track in a transitional region, for deviating rail-guided transport items independent of one another from the guide region of the first rail track to the guide region of the second rail track, a deviation apparatus in said transitional region extending from the guide region of the first rail track to the guide region of the second rail track and which has a conveying element driven in rotation in the direction of transport of the transport item and bridging said transitional region; and controlled coupling means that function to couple a transport item, arriving on the first rail track to be supplied to the second rail track, to the conveying element in the guide region of the first rail track, to hold said transport item on the conveying element during the run through the transitional region and to release said transport item from the conveying element in the guide region of the second rail track.

2. The device as claimed in claim 1, wherein the transitional region (20) has a bend and the deviation apparatus (26) is arranged on the inner side of the bent transitional region (20).

3. The device as claimed in claim 1, wherein the coupling means (56) are assigned to the deviation apparatus (26).

4. The device as claimed in claim 3, wherein the conveying element (30) has a support element (28') driven continuously in rotation and the coupling means (56) have a controlled clamping element (51) rotating synchronously with the support element (28'), in order to clamp a transport item (12), to be supplied to the second rail track (16), between the support element (28') and the clamping element (51).

5. The device as claimed in claim 4, wherein the transport items (12) have shoulders (40, 40') intended for cooperating with the support element (28') and the clamping element (51).

6. The device as claimed in claim 4, wherein the clamping element (51) has a lamellar wheel (42) with lamellae (42') which are separated from one another radially on the outside and which are capable of being moved in the direction toward the support element (28') into a clamping position preferably by means of an electromagnet (48).

7. The device as claimed in claim 4, wherein the support element (28') is designed in the form of a disk and is mounted rotatably about its axis (34').

8. The device as claimed in claim 4, wherein the support element (28') is formed by links (86) of a chain (82) guided around deflecting wheels (80, 84), preferably every n'th chain link, with n greater than 1, being a support link (86), and the chain links arranged adjacently to the support links (86) being driving links (86').

9. The device as claimed in claim 1, wherein the conveying element (30) is preceded by a controlled timed-entry unit (88) which is intended for supplying a transport item (12) to the conveying element (30) at specific times in each case.

10. The device as claimed in claim 2, defined by a third rail track (18) likewise arranged at an angle ($\alpha'$) relative to the first rail track (14) and located opposite the second rail track (16), by a further conveying element (30) which is arranged on the inner side of the corresponding transitional region (20') having a bend (22) and which is driven in the direction from the first rail track (14) to the third rail track (18), and by controlled further coupling means (56), in order to couple a transport item (12), arriving on the first rail track (14) and be supplied to the third rail track (18), to the further conveying element (30) and to hold said transport item on the further conveying element (30) during the run through the transitional region (20').

11. The device as claimed in claim 2, defined by a third rail track (18) likewise arranged at an angle ($\alpha'$) relative to the second rail track (16) and located opposite the first rail track (14), by a further conveying element (30) which is arranged on the inner side of the corresponding transitional region (20') having a bend (22) and which is driven in the direction from the third rail track (18) to the second rail track (16), by controlled further coupling means (56), in order to couple a transport item (12), arriving on the third rail track (18) and to be supplied to the second rail track (16), to the further conveying element (30) and to hold said transport item on the further conveying element (30) during the run through the transitional region (20'), and by a controlled further timed-entry unit (88) which precedes the conveying element (30) and which is intended for supplying a transport item (12) to the further conveying element (30) at specific times in each case.

12. The device as claimed in claim 11, wherein the timed-entry units (88) are driven in exact opposition.

13. The device as claimed in claim 10, wherein the further conveying element (30) and the further coupling means (42) are designed symmetrically with respect to the conveying element (30) and the coupling means (42).

14. The device as claimed in claim 2, wherein the rail tracks are channel-shaped and include lateral flanks, the transport items are designed as inside runners relative to the lateral flanks of the rail tracks, said lateral flanks facing the inner side of the bend and are connected by means of a guide element running between the conveying element and the coupling means.

15. The device as claimed in claim 1, wherein carrying elements, equipped with individually controllable clamps, for the transportation of piece goods, in particular sheet-like products, are arranged on the transport items.

16. The device as claimed in claim 15, wherein the carrying elements (72) are mounted rotatably on the transport items (12), and control means (76) for the rotation of the carrying elements (72) in relation to the transport items (12) are present in the transitional region.

17. The device as claimed in claim 1, wherein the transport items (12) have, as seen in the direction of transport (T), lateral, preferably convex driving faces (70) which are intended for cooperating with intermittently driven driving wheels (90) of timed-entry units (88).

18. The device as claimed in claim 2, wherein the coupling means (56) are assigned to the deviation apparatus (26).

19. The device as claimed in claim 18, wherein the conveying element (30) has a support element (28') driven continuously in rotation and the coupling means (56) have a controlled clamping element (51) rotating synchronously with the support element (28'), in order to clamp a transport item (12), to be supplied to the second rail track (16), between the support element (28') and the clamping element (51).

20. The device as claimed in claim 19, wherein the transport items (12) have shoulders (40, 40') intended for cooperating with the support element (28') and the clamping element (51).

21. The device as claimed in claim 5, wherein the clamping element (51) has a lamellar wheel (42) with lamellae (42') which are separated from one another radially on the outside and which are capable of being moved in the direction toward the support element (28') into a clamping position preferably by means of an electromagnet (48).

22. The device as claimed in claim 5, wherein the support element (28') is designed in the form of a disk and is mounted rotatably about its axis (34').

23. The device as claimed in claim 5, wherein the support element (28') is formed by links (86) of a chain (82) guided around deflecting wheels (80, 84), preferably every n'th chain link, with n greater than 1, being a support link (86), and the chain links arranged adjacently to the support links (86) being driving links (86').

24. The device as claimed in claim 2, wherein the conveying element (30) is preceded by a controlled timed-entry unit (88) which is intended for supplying a transport item (12) to the conveying element (30) at specific times in each case.

25. The device as claimed in claim 3, defined by a third rail track (18) likewise arranged at an angle ($\alpha'$) relative to the first rail track (14) and located opposite the second rail track (16), by a further conveying element (30) which is arranged on the inner side of the corresponding transitional region (20') having a bend (22) and which is driven in the direction from the first rail track (14) to the third rail track (18), and by controlled further coupling means (56), in order to couple a transport item (12), arriving on the first rail track (14) and be supplied to the third rail track (18), to the further conveying element (30) and to hold said transport item on the further conveying element (30) during the run through the transitional region (20').

26. The device as claimed in claim 3, defined by a third rail track (18) likewise arranged at an angle ($\alpha'$) relative to the second rail track (16) and located opposite the first rail track (14), by a further conveying element (30) which is arranged on the inner side of the corresponding transitional region (20') having a bend (22) and which is driven in the direction from the third rail track (18) to the second rail track (16), by controlled further coupling means (56), in order to couple a transport item (12), arriving on the third rail track (18) and to be supplied to the second rail track (16), to the further conveying element (30) and to hold said transport item on the further conveying element (30) during the run through the transitional region (20'), and by a controlled further timed-entry unit (88) which precedes the conveying element (30) and which is intended for supplying a transport item (12) to the further conveying element (30) at specific times in each case.

27. The device as claimed in claim 26, wherein the timed-entry units (88) are driven in exact opposition.

28. The device as claimed in claim 25, wherein the further conveying element (30) and the further coupling means (42) are designed symmetrically with respect to the conveying element (30) and the coupling means (42).

29. The device as claimed in claim 3, wherein the rail tracks (14, 16, 18) are channel-shaped and the transport items (12) are designed as inside runners, and the lateral flanks (24) of the rail tracks (14, 16, 18), said lateral flanks facing the inner side of the bend (22), are connected by means of a guide element (24') running between the conveying element (30) and the coupling means (56).

30. The device as claimed in claim 2, wherein carrying elements (72), preferably equipped with individually controllable clamps, for the transportation of piece goods, in particular sheet-like products, such as printing house products, are arranged on the transport items (12).

31. The device as claimed in claim 30, wherein the carrying elements (72) are mounted rotatably on the transport items (12), and control means (76) for the rotation of the carrying elements (72) in relation to the transport items (12) are present in the transitional region.

32. The device as claimed in claim 2, wherein the transport items (12) have, as seen in the direction of transport (T), lateral, preferably convex driving faces (70) which are intended for cooperating with intermittently driven driving wheels (90) of timed-entry units (88).

* * * * *

UNITED STATES PATENT AND TRADEMARK OFFICE

CERTIFICATE OF CORRECTION

PATENT NO. : 6,364,092 B1
DATED : April 2, 2002
INVENTOR(S) : Markus Felix

It is certified that error appears in the above-identified patent and that said Letters Patent is hereby corrected as shown below:

Column 10,
Line 16, delete “track,” and substitute -- track; -- in its place.

Signed and Sealed this

Fourteenth Day of January, 2003

JAMES E. ROGAN
*Director of the United States Patent and Trademark Office*